US009568228B2

(12) United States Patent
Joung et al.

(10) Patent No.: US 9,568,228 B2
(45) Date of Patent: Feb. 14, 2017

(54) ICE MAKING METHOD

(75) Inventors: Jin-Kyu Joung, Seoul (KR); You-Shin Kim, Seoul (KR); Chul-Sun Dan, Seoul (KR)

(73) Assignee: Woongjin Coway Co., Ltd (KR)

( * ) Notice: Subject to any disclaimer, the term of this patent is extended or adjusted under 35 U.S.C. 154(b) by 910 days.

(21) Appl. No.: 13/702,502

(22) PCT Filed: Jun. 22, 2011

(86) PCT No.: PCT/KR2011/004566

§ 371 (c)(1),
(2), (4) Date: Dec. 6, 2012

(87) PCT Pub. No.: WO2011/162547

PCT Pub. Date: Dec. 29, 2011

(65) Prior Publication Data

US 2013/0074521 A1 Mar. 28, 2013

(30) Foreign Application Priority Data

Jun. 24, 2010 (KR) ..... 10-2010-0059894
Jun. 15, 2011 (KR) ..... 10-2011-0058108

(51) Int. Cl.
*F25C 1/00* (2006.01)
*F25C 5/10* (2006.01)
(Continued)

(52) U.S. Cl.
CPC ..... *F25C 1/00* (2013.01); *F25B 21/02* (2013.01); *F25B 21/04* (2013.01); *F25C 1/08* (2013.01);
(Continued)

(58) Field of Classification Search
CPC ... F25C 2305/00; F25C 2305/022; F25C 1/10; F25C 1/22; F25C 1/04; F25C 1/045; F25C 1/06; F25C 5/08; F25C 5/10
See application file for complete search history.

(56) References Cited

U.S. PATENT DOCUMENTS 3,433,030 A * 3/1969 Jacobs ..... 62/186
3,708,208 A 1/1973 Fuss
(Continued)

FOREIGN PATENT DOCUMENTS

CN 1936465 3/2007
CN 101881536 11/2010
(Continued)

OTHER PUBLICATIONS

PCT/ISA/237 Written Opinion issued on PCT/KR2011/004566 (pp. 3).
(Continued)

*Primary Examiner* — Ryan J Walters
*Assistant Examiner* — Erik Mendoza-Wilkenfe
(74) *Attorney, Agent, or Firm* — The Farrell Law Firm, P.C.

(57) ABSTRACT

There is provided an ice making method capable of forming ice to an intended level although a sensing unit configured to sense whether or not a formation of ice has reached the intended level malfunctions. The ice making method includes: an ice making initiation step S100 of forming ice by an ice formation unit; an ice release time determining step S200 of determining a point in time at which ice is to be released in consideration of a signal from a detection unit for detecting whether the formation of ice has reached an intended level and an ice making lapse time which has lapsed after the formation of ice was initiated by the ice formation unit; and an ice releasing step S300 of releasing
(Continued)

the formed ice when a point in time at which ice is to be released is determined in the ice releasing time determining step.

10 Claims, 5 Drawing Sheets

(51) Int. Cl.

| | |
|---|---|
| ***F25B 21/02*** | (2006.01) |
| ***F25C 5/08*** | (2006.01) |
| ***F25B 21/04*** | (2006.01) |
| ***F25C 1/08*** | (2006.01) |
| ***F25C 1/20*** | (2006.01) |
| *F25D 25/04* | (2006.01) |

(52) U.S. Cl.
CPC . *F25C 1/20* (2013.01); *F25C 5/08* (2013.01); *F25C 5/10* (2013.01); *F25C 2305/022* (2013.01); *F25C 2600/02* (2013.01); *F25C 2600/04* (2013.01); *F25C 2700/02* (2013.01); *F25D 25/04* (2013.01)

(56) References Cited

U.S. PATENT DOCUMENTS

| | | | | |
|---|---|---|---|---|
| 5,199,270 | A * | 4/1993 | Simkens | 62/73 |
| 5,425,243 | A * | 6/1995 | Sanuki et al. | 62/138 |
| 5,527,470 | A * | 6/1996 | Suda | G01N 33/18 210/739 |
| 5,931,003 | A | 8/1999 | Newman et al. | |
| 6,339,930 | B2 * | 1/2002 | Horey | 62/138 |
| 6,688,131 | B1 * | 2/2004 | Kim et al. | 62/353 |
| 6,951,113 | B1 * | 10/2005 | Adamski | 62/3.62 |
| 2004/0107721 | A1 * | 6/2004 | Choi et al. | 62/340 |
| 2004/0216474 | A1 * | 11/2004 | Jablonski | A23G 9/045 62/137 |
| 2005/0126185 | A1 * | 6/2005 | Joshi | 62/3.6 |
| 2005/0235665 | A1 * | 10/2005 | Kim et al. | 62/135 |
| 2007/0079627 | A1 | 4/2007 | Broadbent et al. | |
| 2009/0049858 | A1 * | 2/2009 | Lee et al. | 62/349 |
| 2009/0211271 | A1 * | 8/2009 | Kim et al. | 62/73 |
| 2009/0223230 | A1 * | 9/2009 | Kim | F25C 1/08 62/73 |
| 2009/0320501 | A1 * | 12/2009 | Morimoto et al. | 62/66 |
| 2010/0077774 | A1 | 4/2010 | Takagi et al. | |
| 2010/0218519 | A1 * | 9/2010 | Hall et al. | 62/73 |

FOREIGN PATENT DOCUMENTS

| | | |
|---|---|---|
| JP | 01-134185 | 5/1989 |
| JP | 10047713 | 2/1998 |
| JP | 2853899 | 2/1999 |
| KR | 10-0272894 | 11/2000 |
| KR | 1020040085600 | 10/2004 |
| KR | 100814687 | 3/2008 |
| KR | 1020080103860 | 11/2008 |

OTHER PUBLICATIONS

PCT/ISA/210 Search Report issued on PCT/KR2011/004566 (pp. 3).
European Search Report dated Sep. 12, 2016 issued in counterpart application No. 11798382.5-1605, 6 pages.

* cited by examiner (d)

(e)

ICE MAKING METHOD

PRIORITY

This application is a National Phase Entry of PCT International Application No. PCT/KR2011/004566 filed Jun. 22, 2011, and claims priority to Korean Patent Application Nos. 10-2010-0059894 and 10-2011-0058108 filed with the Korean Intellectual Property Office on Jun. 24, 2010 and Jun. 15, 2011, respectively, the contents of each of which is incorporated herein by reference.

TECHNICAL FIELD

The present invention relates to an ice making method capable of forming ice to an intended level even in the case that a sensing unit configured to sense whether or not a formation of ice has reached the intended level malfunctions.

BACKGROUND ART

An ice maker IM is designed to make ice I, and such an ice maker IM is provided in a water purifier, a refrigerator, or the like.

As illustrated in FIG. 1, the ice maker IM includes an evaporator E in which a cold refrigerant or a hot refrigerant flows in a refrigerating cycle (not shown). Also, one or more dipping members D are connected to the evaporator E, and a cold refrigerant or a hot refrigerant may flow in the dipping members D. A tray member T is also provided in the ice maker IM. Water is maintained in the tray member T, and the plurality of dipping members D are immersed in water in the tray member T. Accordingly, with the one or more dipping members D immersed in the tray member T, when a cold refrigerant flows in the dipping members D, ice I is formed on the dipping members D. After the ice I is formed on the dipping members D, when a hot refrigerant flows in the dipping members D, the ice I formed on the dipping members D is separated from the dipping members D. Namely, the ice I is released.

Meanwhile, in order for the ice maker IM to make ice I having an intended size, the size of the ice I may be detected (or determined) and when the formation of ice has reached an intended level, the ice I may be released. In this case, in order to detect whether or not the formation of the ice I has reached the intended level, as illustrated in FIG. 1, a gyration member C, provided to gyrate in a tray member T, and a sensor S, associated with the gyration member C, may be used.

As shown in FIG. 1, the gyration member C may include a contact member Ca and an electromagnetic wave reflective member Cb, and the sensor S may include an electromagnetic wave transmission member S1 and an electromagnetic wave reception member S2. When the formation of ice I has not reached the intended level, electromagnetic waves transmitted from the electromagnetic wave transmission member S1, according to the gyration of the gyration member C, may be reflected by the electromagnetic wave reflective member Cb of the gyration member C and received by the electromagnetic wave reception member S2.

Meanwhile, when the formation of ice has reached the intended level, the contact member Ca of the gyration member C is brought into contact with the ice I, so the electromagnetic waves transmitted from the electromagnetic wave transmission member S1 are not received by the electromagnetic wave reception member S2 according to the gyration of the gyration member C. Then, when it is determined that the formation of the ice I has reached the intended level, the ice I is released.

In the ice making method, if a foreign object (i.e., debris), or the like, is attached to the sensor S, even if the formation of ice I has already reached the intended level, electromagnetic waves transmitted by the electromagnetic wave transmission member S1 may still be received by the electromagnetic wave reception member S2 so it may be continuously determined that the formation of ice I has not reached the intended level. Also, if a foreign object, or the like, is caught by the gyration member C, although the formation of ice I has not reached the intended level, electromagnetic waves transmitted by the electromagnetic wave transmission member S1 may not be received by the electromagnetic wave reception member S2 so it may be detected (or determined) that the formation of ice I has reached the intended level.

Namely, a malfunction of the ice (I) size detection unit, such as the gyration member C, the sensor S, or the like, may lead to a failure in making ice I having the intended size.

Meanwhile, in the above description, the dipping type ice maker in which a refrigerant flows and which includes the dipping members D immersed in water in the tray member D is taken as an example, but the same problem may arise in any other types of ice makers. For example, a water flow type ice maker in which water is jetted to an ice making pin in which a refrigerant flows to form ice on the ice making pin, or an injection type (or jet type) ice maker in which water is jetted to ice making plate provided an evaporator with a refrigerant flowing therein and including one or more cells so as to make ice in the one or more cells may have the same problem.

DISCLOSURE OF INVENTION

Technical Problem

The present disclosure has been made upon recognizing at least one of the requests made or problems caused in the related art ice making method as mentioned above.

An aspect of the present invention provides an ice making method capable of releasing ice when a certain period of time has lapsed even in the case that a detection unit for detecting whether or not a formation of ice has reached an intended level malfunctions.

Another aspect of the present invention provides an ice making method capable of making ice having an intended size even in the case that a detection unit for detecting whether or not a formation of ice has reached an intended level malfunctions.

Solution to Problem

An ice making method in relation to an embodiment for accomplishing at least one of the foregoing objects may have the following characteristics.

The present disclosure is based on releasing ice when a certain period of time has lapsed even in the case that a detection unit for detecting whether or not a formation of ice has reached an intended level malfunctions.

According to an aspect of the present invention, there is provided an ice making method including: an ice making initiation step of forming ice by an ice formation unit; an ice release time determining step of determining a point in time at which ice is to be released in consideration of a signal from a detection unit for detecting whether the formation of ice has reached an intended level and an ice making lapse time which has lapsed after the formation of ice was initiated by the ice formation unit; and an ice releasing step of releasing the formed ice when a point in time at which ice is to be released is determined in the ice releasing time determining step.

In the ice release time determining step, when the ice making lapse time is equal to a pre-set maximum ice making time, it may be determined as an ice releasing time although it is not detected (or determined) that the formation of ice has reached the intended level by the detection unit.

In the ice release time determining step, although the ice making lapse time is less than a pre-set minimum ice making time, when it is detected (or determined) that the formation of ice has reached the intended level by the detection unit, it may be determined that it is time to release ice when the minimum ice making time has expired.

The minimum ice making time may be 80% to 90% of the pre-set maximum ice making time.

The maximum ice making time or the minimum ice making time may be changed according to an outdoor temperature.

The ice formation unit may form ice in a tray member with water therein after water is supplied to the tray member, and the detection unit may detect whether or not the formation of ice in the tray member has reached an intended level.

The detection unit may include a gyration member provided to gyrate in the tray member and a sensor in association with the gyration member, and detect whether or not the formation of ice on dipping members has reached an intended level.

The ice formation unit may include one or more dipping members which are immersed in water in the tray member and in which a refrigerant flows.

In the ice making step, water may be supplied to the tray member such that the one or more dipping members are immersed in the dipping member, and a cold refrigerant is supplied to the one or more dipping members to form ice on the dipping members, in the ice release time determining step, a point in time at which the cold refrigerant is supplied to the dipping members may be a point in time at which ice starts to be formed, and in the ice releasing step, ice formed on the one or more dipping members may be released.

In the ice releasing step, a hot refrigerant may be supplied to the one or more dipping members to release ice formed on the one or more dipping members.

The ice formation unit may include: one or more dipping members immersed in water in the tray member; and a thermoelectric module connected to the one or more dipping members.

In the ice making step, water may be supplied to allow the one or more dipping members to be immersed in the tray member and the thermoelectric module is driven to form ice on the dipping members, and in the ice release time determining step, a point in time at which the thermoelectric module is driven may be determined as a point in time at which ice starts to be formed, and in the ice releasing step, ice formed on the one or more dipping members may be released.

In the ice releasing step, the thermoelectric module may be driven in reverse to release ice formed on the one or more dipping members.

The ice formation unit may include: one or more ice making pins in which a refrigerant flows; a jet housing including one or more ice making pin inserting holes into which the one or more ice making pins are inserted, and allowing water to be introduced thereinto; one or more injectors formed in the ice making pin inserting holes to allow water to be jetted to the ice making pins therethrough to form ice; and a storage tank collecting water which has not been frozen upon being jetted to the ice making pins so as to be kept in storage, and connected to the jet housing so as to supply water to the jet housing.

The ice formation unit may include: an ice making plate including an evaporator in which a refrigerant flows and having one or more cells; and a nozzle connected to a water supply source and jetting water to each of the cells to form ice.

Advantageous Effects of Invention

According to exemplary embodiments of the invention, even in the case that a detection unit for detecting whether or not a formation of ice has reached an intended level malfunctions, ice may be released when a certain period of time has lapsed.

Also, even in the case that a detection unit for detecting whether or not a formation of ice has reached an intended level malfunctions, ice having an intended size can be obtained.

MODE FOR THE INVENTION

Figure 1:
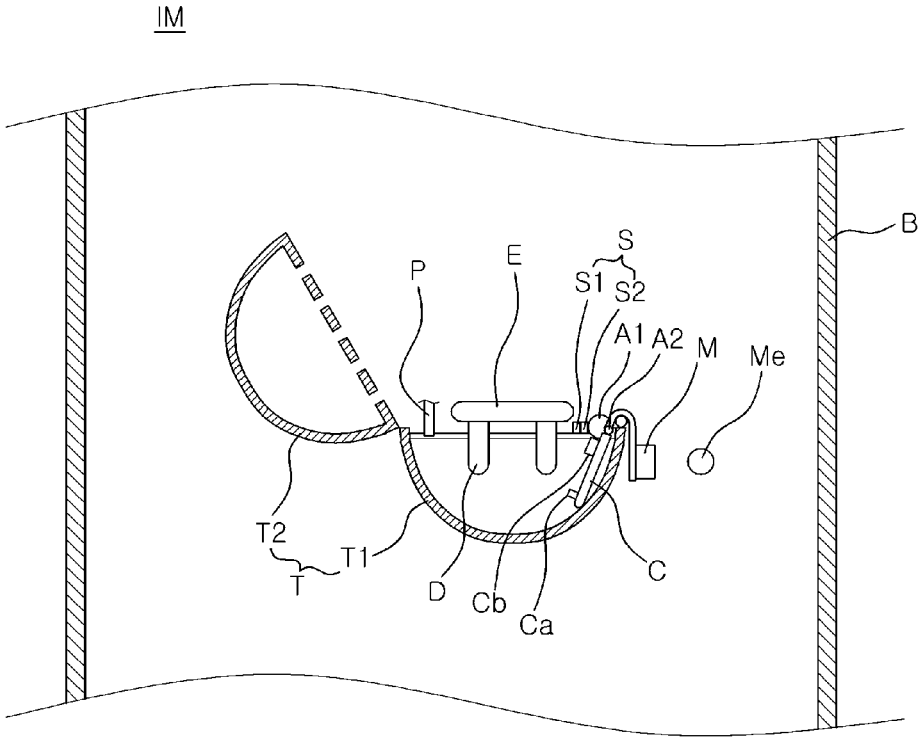
FIG. 1 shows an example of an ice maker to which an example of an ice making method according to an embodiment of the present invention may be applicable.

An ice making method according to an embodiment of the present invention will be described in detail hereinafter to help in an understanding of the characteristics of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Embodiments of the present invention are based on releasing ice when a certain period of time has lapsed even in the case that a detection unit for detecting whether or not a formation of ice has reached an intended level malfunctions.

Figure 5:
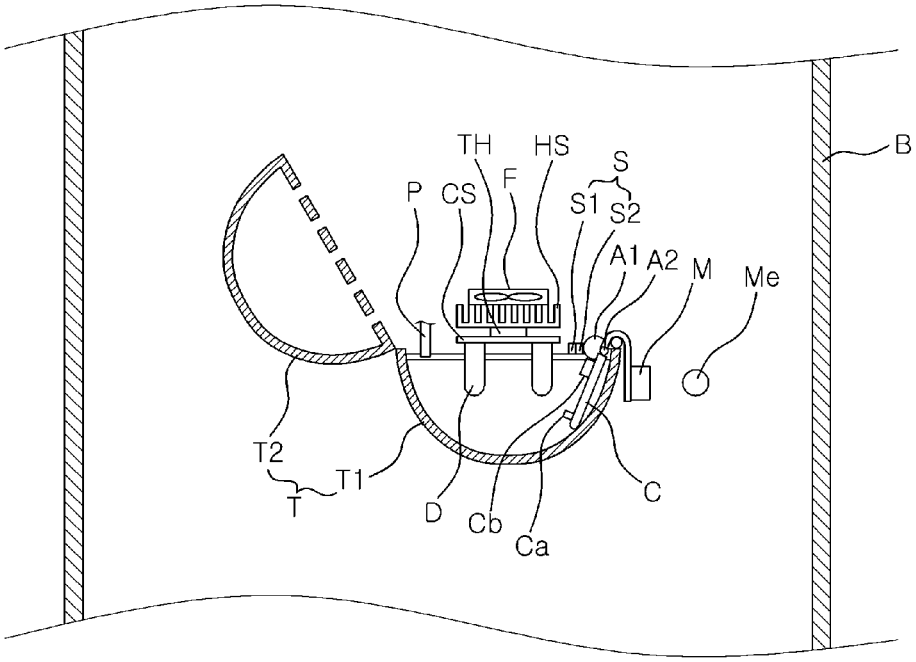
FIG. 5 shows another example of an ice maker to which an example of an ice making method according to an embodiment of the present invention may be applicable.

FIGS. 1 and 5 show two examples of an ice maker IM according to embodiments of the present invention to which an ice making method according to an embodiment of the present invention can be applicable. As illustrated, the ice maker IM to which the ice making method according to an embodiment of the present invention can be applicable may be provided to a main body B.

As shown in FIG. 1, the ice maker IM may include an evaporator E included in a refrigerating cycle (not shown). A cold refrigerant or a hot refrigerant may flow in the evaporator E. Also, as illustrated, one or more dipping members D may be connected to the evaporator E. Accordingly, the cold refrigerant or the hot refrigerant may also flow in the one or more dipping members D.

In addition, as shown in FIG. 5, a thermoelectric module may be provided in the ice maker IM. As illustrated, the one or more dipping members D may be connected to thermoelectric module. Accordingly, when the thermoelectric module is driven, the one or more dipping members D may be cooled, and when the thermoelectric module is driven in reverse, the one or more dipping members D may be heated.

As shown in FIGS. 1 and 5, a tray member T, into which water is inserted and which allows the one or more dipping members D to be immersed therein, may be rotatably provided in the ice maker IM. The tray member T may include a main tray member T1, in which water is provided to allow the dipping members D to be immersed therein, provided in the main body B such that it is rotatable about a rotational shaft A1 by being centered thereon, and an auxiliary tray member T2 connected to the main tray member T1. However, the tray member T is not limited to the illustrated tray member, and any tray member may be used so long as it can maintain water, in which the one or more dipping members D are immersed, therein. Meanwhile, water may be supplied to the tray member T, specifically, to the main tray member T1, through a water supply pipe P connected to a water purification tank (not shown), a cold water tank (not shown), or the like.

As shown in FIGS. 1 and 5, the gyration member C is provided to gyrate about a rotational shaft A2 by being centered thereupon in the tray member T, specifically, in the main tray member T1. To this end, as shown in FIGS. 1 and 5, a magnetic substance M such as a permanent magnet, or the like, may be provided on the gyration member C. A magnetic force generation member Me, such as an electromagnet, or the like, may be provided in the main body B. With such a configuration, when a magnetic force having a direction the same as or opposite to that generated by the magnetic substance M is generated by the magnetic force generation member Me periodically, the gyration member C can periodically gyrate about the rotational shaft A2 by being centered thereupon within the tray member T, specifically, in the main tray member T1, illustrated in FIGS. 1 and 5.

Accordingly, waves may be generated in the water within the tray member T, specifically, the main tray member T1 illustrated in FIGS. 1 and 5. Owing to the waves generated thusly, a bubble layer can be prevented from being grown in ice I when the ice I is formed while a cold refrigerant flows in the dipping members D or the thermoelectric module is driven. Accordingly, highly transparent ice I can be formed on the dipping members D. However, the configuration of the periodic gyration of the gyration member C is not limited to the magnetic substance M and the magnetic force generation member Me as shown in FIGS. 1 and 5, and any configuration including a configuration in which the gyration member C periodically gyrates in the tray member T, specifically, in the main tray member T1, illustrated in FIGS. 1 and 5, a configuration in which the gyration member C periodically gyrates by a driving motor (not shown), or the like, can be used.

Meanwhile, in order to detect whether or not the formation of ice I has reached an intended level, as shown in FIGS. 1 and 5, a sensor S is provided in the main body B. The sensor S, in association with the gyration member C, may be able to detect whether or not the formation of ice has reached the intended level. To this end, as shown in FIGS. 1 and 5, the sensor S may include an electromagnetic wave transmission member S1 for transmitting electromagnetic waves and an electromagnetic wave reception member S2 for receiving electromagnetic waves. The gyration member C may include a contact member Ca and an electromagnetic wave reflective member Cb.

Figure 2:
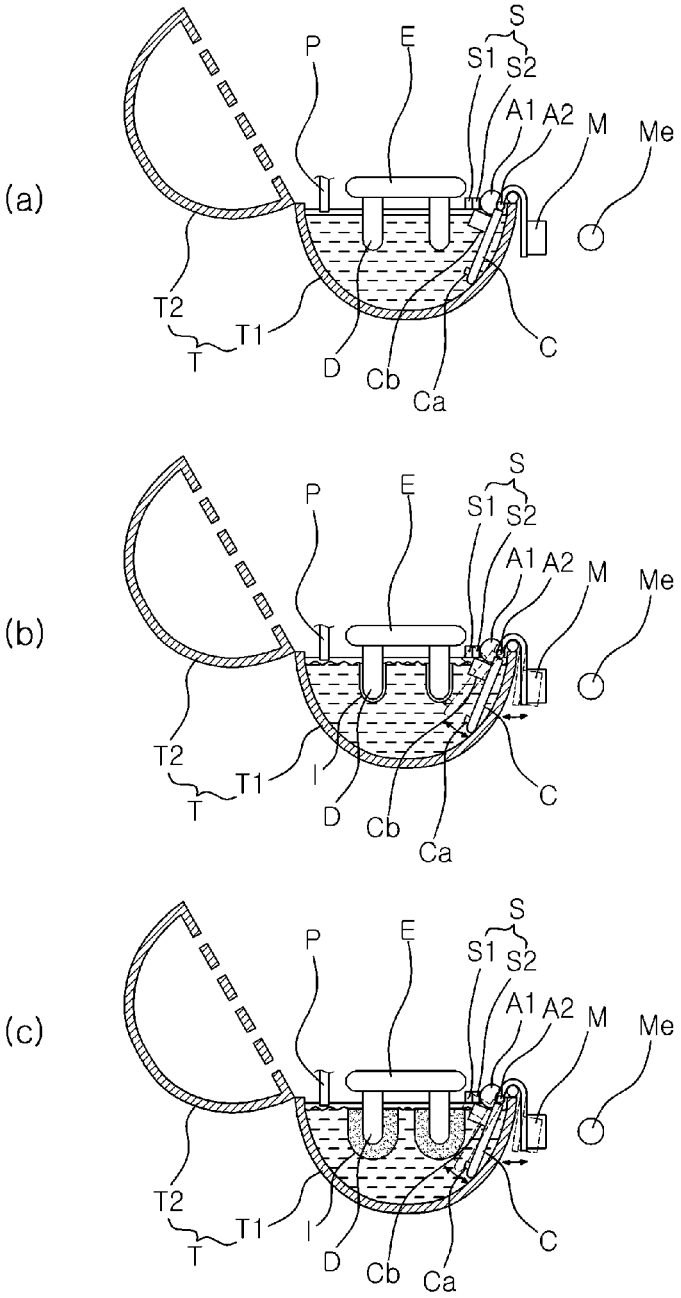
FIGS. 2 and 3 show how the ice maker illustrated in FIG. 1 detects whether or not a formation of ice has reached an intended level and releases ice.

With such a configuration, when the formation of ice I has not reached the intended level as shown in FIG. 2(*c*), according to the gyration of the gyration member C, electromagnetic waves transmitted from the electromagnetic wave transmission member S1 are reflected by the electromagnetic wave reflective member Cb of the gyration member C and received by the electromagnetic wave reception member S2. The transmission of the electromagnetic waves from the electromagnetic wave transmission member S1, the reflection of electromagnetic waves by the electromagnetic wave reflective member Cb, and the reception of the electromagnetic waves by the electromagnetic wave reception member S2 may be performed periodically, according to a periodical gyration of the gyration member C.

Meanwhile, when the formation of ice has reached the intended level, the contact member Ca of the gyration member C is brought into contact with the ice I. Then, the transmission of the electromagnetic waves from the electromagnetic wave transmission member S1, the reflection of electromagnetic waves by the electromagnetic wave reflective member Cb, and the reception of the electromagnetic waves by the electromagnetic wave reception member S2 as mentioned above are not performed. Thus, it can be detected (or determined) that the formation of ice has reached an intended level, and accordingly, the ice I is released.

However, the configuration of the detection unit for detecting whether or not the formation of ice I has reached an intended level is not limited to the configuration of the electromagnetic wave transmission member S1, the electromagnetic wave reception member S2, the contact member Ca, the electromagnetic wave reflective member Cb, and the like, as shown in FIGS. 1 and 5, and any configuration may be implemented so long as it can detect whether or not the formation of ice I has reached an intended level. For example, the detection unit may include a sensor (not shown) provided in the tray member T such that the sensor comes into contact with the ice I when the formation of the ice I has reached an intended level, a detection member (not shown) provided in the tray member T such that the detection member gyrates when the formation of the ice I has reached an intended level, or an electromagnetic wave transmission member (not shown) and an electromagnetic wave reception member (not shown) for cutting off an electromagnetic wave path when the formation of the ice I has reached an intended level.

Also, the ice maker IM, to which the ice making method according to an embodiment of the present invention can be applicable, is not limited to the embodiments illustrated in FIGS. 1 and 5 and any ice maker IM may be implemented so long as it can detect whether or not a formation of ice I has reached an intended level and releases the ice I.

Figure 4:
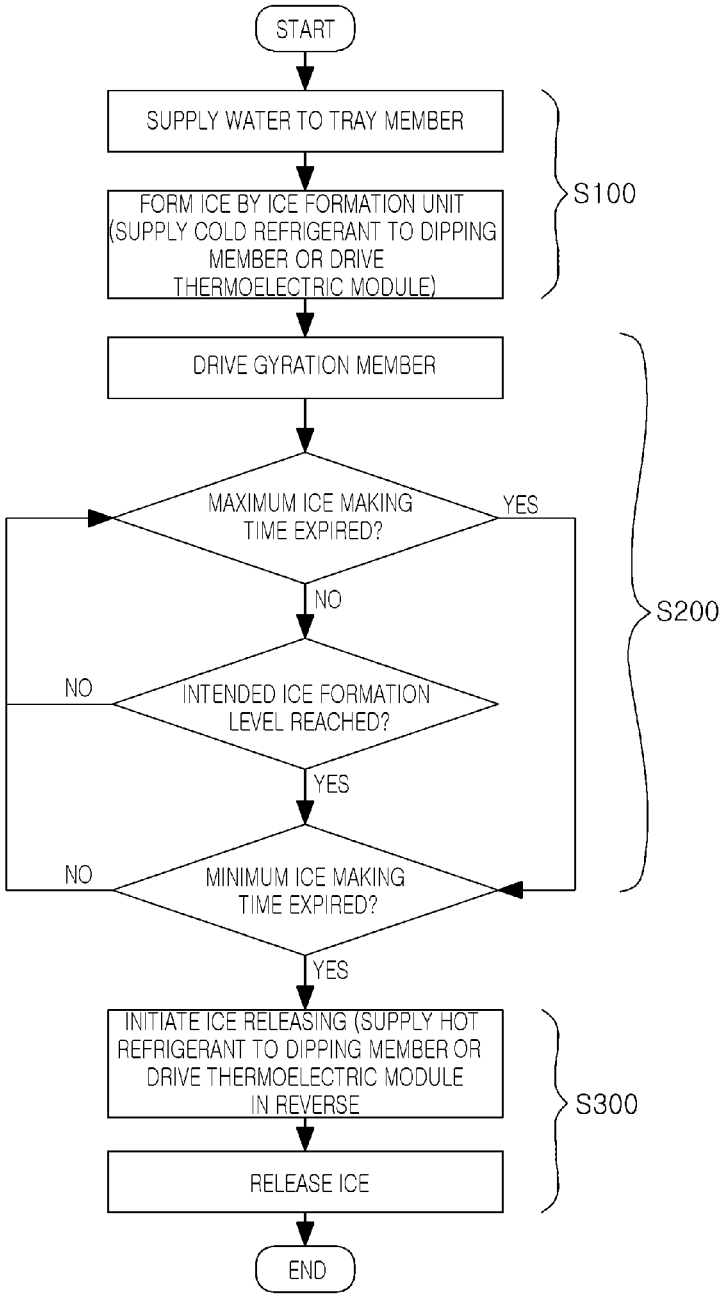
FIG. 4 is a flow chart illustrating the process of an ice making method according to an embodiment of the present invention.

The ice making method according to an embodiment of the present invention may include an ice making initiation step S100, an ice release time determining step S200, and an ice releasing step S300 as shown in FIG. 4.

In the ice making initiation step S100, ice I may be formed by an ice formation unit. The ice formation unit may form ice I in the tray member T with water therein after water is supplied to the tray member T. In the embodiment illustrated in FIGS. 1 and 5, water is supplied to allow the one or more dipping members D to be immersed in water as shown in FIG. 4. In this state, ice I is formed in the tray member T by the ice formation unit in association with the tray member T.

The ice formation unit may include one or more dipping members D which are immersed in water in the tray member T and in which a refrigerant flows. The ice formation unit in the ice maker IM according to the embodiment illustrated in FIG. 5 may include one or more dipping members D immersed in water in the tray member T and a thermoelectric module TH connected to the one or more dipping members D. The thermoelectric module TH may include a thermoelectric element. Also, as illustrated, one end of the thermoelectric module TH may be connected to the dipping members D by means of a cold sink CS. The other end of the thermoelectric module TH may be connected to a heat sink HS, and a fan F may be connected to the heat sink HS as illustrated.

Accordingly, in the embodiment illustrated in FIG. 1, a cold refrigerant is supplied to the one or more dipping members D in order to form ice I on the one or more dipping members D. Also, in the embodiment illustrated in FIG. 5, the thermoelectric module TH is driven to allow ice I to be formed on the one or more dipping members Dl.

An ice formation unit, other than those in the embodiments illustrated in FIGS. 1 and 5, is not illustrated, but it may include one or more ice making pins, a jet housing, one or more injectors, and a storage tank.

A refrigerant may flow in each of the one or more ice making pins. To this end, the one or more ice making pins may be connected to an evaporator in which a refrigerant flows as mentioned above. One or more ice making pin inserting holes, into which one of more ice making pins are inserted, respectively, may be formed on the jet housing. Also, the jet housing may be configured to allow water to be introduced thereinto.

One or more injectors may be formed in the ice making pin inserting holes of the jet housing. Accordingly, water introduced into the jet housing may be jetted to the ice making pins through the injectors. Thus, when water is jetted in the manner as described above while the cold refrigerant flows in the ice making pins, ice can be formed on the ice making pins.

Meanwhile, water, which has not been frozen upon being jetted to the ice making pins, may be collected in the storage tank and kept therein. The storage tank may be connected to the jet housing in order to supply water to the jet housing. Accordingly, since water, while being circulated, is jetted to the ice making pins, ice formed on the ice making pins may be grown.

Also, the ice formation unit may include an ice making plate and a nozzle.

The ice making plate may include an evaporator in which a refrigerator flows. Thus, when a cold refrigerant flows in the evaporator, the ice making plate may be cooled. Also, the ice making plate may include one or more cells. The nozzle may be connected to a water supply source such as a storage tank, or the like. Thus, water may be jetted to each of the cells of the ice making plate through the nozzle. Accordingly, when water is jetted to each of the cells of the ice making plate in a state in which the cold refrigerant flows in the evaporator to cool the ice making plate as mentioned above, ice may be formed in each of the cells of the ice making plate. Also, water, which has not been frozen upon being jetted to each of the cells, may be collected to the foregoing water supply source and kept in storage. Accordingly, as water, while being circulated, is jetted to each of the cells of the ice making plate, ice formed in each of the cells can be grown.

In the ice release time determining step S200, a point in time at which ice is to be released may be determined in consideration of a signal from the detection unit for detecting whether or not the formation of the ice I has reached an intended level and an ice making lapse time which has lapsed after the formation of the ice I was initiated by the ice formation unit. Also, the detection unit detection unit may detect whether or not the formation of the ice I on the tray member T has reached an intended level.

In the embodiments illustrated in FIGS. 1 and 5, as shown in FIG. 4, a point in time at which ice is to be released may be determined in consideration of a signal from the detection unit for detecting whether or not the formation of the ice I on the dipping members D has reached an intended level and an ice making lapse time which has elapsed after the formation of the ice I was initiated by the ice formation unit. To this end, in the ice maker IM according to the embodiment illustrated in FIG. 1, a point in time at which a cold refrigerant is supplied to the dipping members D may be determined as a point in time at which ice I starts to be formed. Also, in the ice maker IM according to the embodiment illustrated in FIG. 5, a point in time at which the thermoelectric module TH is driven may be determined as a point in time at which ice I starts to be formed. Meanwhile, the point in time at which the ice I is to be released may be determined by a controller (not shown) provided in the ice maker IM.

The detection unit detecting whether or not the formation of ice I on the dipping members D has reached an intended level may include the gyration member C provided to gyrate in the tray member T and the sensor S in association with the gyration member C. However, the detection unit is not limited thereto and any detection unit may be used so long as it can detect whether or not a formation of ice I on the dipping members D has reached an intended level.

In order to determine a point in time at which ice is to be released in consideration of the signal from the detection unit and the ice making lapse time which has lapsed after the formation of ice I on the dipping members D was initiated by the ice formation unit, a maximum ice making time (or duration) or a minimum ice making time (or duration) may be previously set as shown in FIG. 4.

When the ice making lapse time is equal to the maximum ice making times, it may be determined that it is a point in time at which ice is to be released, although it is not detected (or determined) that the formation of ice I has not reached an intended level by the detection unit. For example, in the ice maker IM illustrated in FIG. 1, if the sensor S is covered by a foreign object (i.e., debris), or the like, although the formation of ice I has already reached the intended level, electromagnetic waves transmitted by the electromagnetic wave transmission member S1 may be still received by the electromagnetic wave reception member S2 so it may be continuously detected (or determined) that the formation of ice I has not reached the intended level. Then, in this case, although it is not detected (or determined) that the formation of ice I has reached the intended level until such time as the ice making lapse time is equal to the maximum ice making time, the maximum ice making time is determined as a point in time at which ice is to be released. Accordingly, although the formation of ice I has reached the intended level, if the detection unit fails to detect it due to its malfunction, the point in time at which ice is to be released may be determined.

Also, although the ice making lapse time is less than the minimum ice making time, when it is detected (or determined) that the formation of ice I has reached the intended level by the detection unit, it may be determined that it is time to release ice when the minimum ice making time expires. For example, in the ice makers IM illustrated in FIGS. 1 and 5, although a minimum ice making time has not expired, if a foreign object, or the like, is caught by the gyration member C, electromagnetic waves transmitted by the electromagnetic wave transmission member S1 may not be received by the electromagnetic wave reception member S2 so it may be detected (or determined) that the formation of ice I has reached the intended level. Then, in this case, although it is detected (or determined) that the formation of the ice I has reached the intended level before the ice making time has is equal to the minimum ice making time, it may not be determined as a point in time at which the ice is to be released but it may be determined that it is time to release ice when the minimum ice making time has expired. Accordingly, the occurrence of a phenomenon in which it is detected (or determined) that the formation of the ice I has reached the intended level, although it is not, by the detection unit due to the malfunction of the detection unit, so it is time to release ice may be prevented.

The maximum ice making time may be set to be a duration in which the formation of ice I has reached an intended level. The maximum ice making time may be arbitrarily set by a user or may be obtained through an experiment.

Meanwhile, the minimum ice making time may be 80% to 90% of the pre-set maximum ice making time. If the minimum ice making time is less than 80% of the maximum ice making time, the size of ice I would be very smaller than the intended size, when the ice I is released after the minimum ice making time has expired due to it is detected that the formation of the ice I has reached the intended level although it is not. If the minimum ice making time exceeds 90% of the maximum ice making time, since the interval between the maximum ice making time and the minimum ice making time is so short, it may not directly detect whether or not the formation of the ice I has reached the intended level to release the ice I, and this is not much different from releasing ice I when the maximum ice making time has expired. Thus, preferably, the minimum ice making time for the conditions in which the size of the released ice I is close to the intended level and whether or not the formation of the ice I has reached the intended level is directly detected (or determined) to release the ice I is 80% to 90% of the maximum ice making time.

Also, the maximum ice making time or the minimum ice making time may be changed according to an outdoor temperature. This is because a duration in which the formation of the ice I has reached the intended level varies. For example, the maximum ice making time in the winter may be 8 minutes, and thus, the minimum ice making time may be 6.5 minutes. Meanwhile, the maximum ice making time in the summer may be 15 minutes, and thus, the minimum ice making time may be 12.5 minutes.

In the ice releasing step S300, when a point in time at which ice is to be released is determined in the ice release time determining step S200 as described above, the formed ice I may be released. For example, the ice I generated in the tray member T may be released. In the ice makers IM according to the embodiments illustrated in FIGS. 1 and 5, ice I formed on the one or more dipping members D as shown in FIG. 4 may be released.

To this end, in the ice maker IM according to the embodiment illustrated in FIG. 1, a hot refrigerant may be supplied to the one or more dipping members D in the ice releasing step S300 to release the ice I formed on the one or more dipping members D. Namely, when the hot refrigerant is supplied to the one or more dipping members D, a portion of the ice I attached to the dipping members D would be thawed and the ice I may be separated from the dipping members D. The ice I separated from the dipping members D is dropped according to self-load (i.e., the weight of the ice I itself). Accordingly, the ice I can be released. Also, in the ice maker IM according to the embodiment illustrated in FIG. 5, the thermoelectric module TH may be driven in reverse in the ice releasing step S300 to release the ice I formed on the one or more dipping members D. However, the method for releasing the ice I formed on the one or more dipping members D is not limited to the methods as described above; any method, such as using a heater, or the like, may be employed so long as it can release the ice I generated on the one or more dipping members D.

The ice making method according to an embodiment of the present invention by using the ice maker IM illustrated in FIG. 1 will now be described in detail with reference to FIGS. 2 to 4.

First, the tray member T is rotated to a position as illustrated in FIG. 2(*a*). Water is supplied to the tray member T, i.e., the main tray member T1, through the water supply pipe P.

Thereafter, as shown in FIG. 2(*b*), a cold refrigerant is supplied to the dipping members D. Accordingly, ice I is formed on the dipping members D.

As shown in FIG. 2(*b*), the gyration member C is driven. As illustrated, when a magnetic force is periodically generated from the magnetic force generation member Me, the gyration member C periodically gyrates in the tray member T, i.e., in the main tray member T1. Also, electromagnetic waves are transmitted from the electromagnetic wave transmission member S1 of the sensor S. The transmitted electromagnetic waves are reflected by the electromagnetic wave reflective member Cb according to the gyration of the gyration member C and received by the electromagnetic wave reception member S2. Accordingly, it may be recognized that the formation of the ice I has not reached the intended level.

Figure 3:
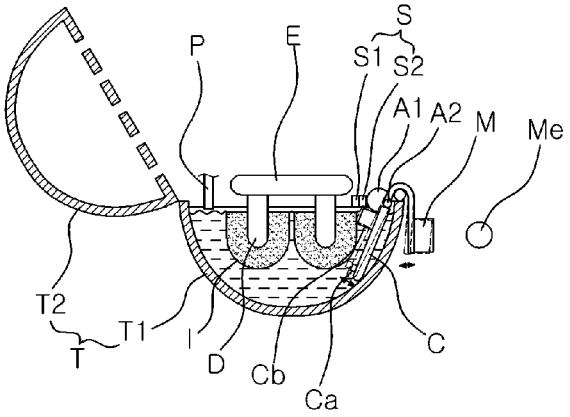
Figure 3:
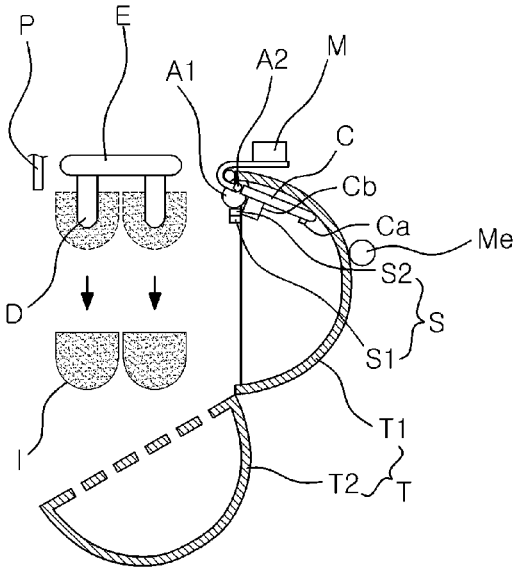

When it is detected (or determined) that the formation of the ice I has reached the intended level as shown in FIG. 3(*d*) between the maximum ice making time and the minimum ice making time, namely, when the electromagnetic waves transmitted by the electromagnetic wave transmission member S1 are not received by the electromagnetic wave reception member S2, a hot refrigerant is supplied to the dipping member D. And, as shown in FIG. 3(*e*), the tray member T rotates and the ice I is separated from the dipping members D so as to be released.

Meanwhile, when it is detected (or determined) that the formation of the ice I has reached the intended level before the minimum ice making time expires, the ice I is not released. After the minimum ice making time expires, the ice I is released as shown in FIG. 3(*e*).

When it is not detected (or determined) that the formation of the ice I has reached the intended level until when the maximum ice making time expires, when the maximum ice making time expires, the ice I is released as shown in FIG. 3(*e*).

In this manner, when the ice making method according to an embodiment of the present invention is used, although the detection unit for detecting whether or not the formation of the ice I has reached the intended level malfunctions, when a certain period of time has lapsed, ice can be released, and accordingly, although the detection unit for detecting whether or not the formation of the ice I has reached the intended level malfunctions, ice having an intended size can be obtained.

The foregoing ice making method may not be applicable to limit the configuration of the foregoing embodiments, but the entirety or a portion of the respective embodiments may be selectively combined and configured to implement various modifications.

The invention claimed is:

1. An ice making method comprising:

an ice making initiation operation of forming ice by an ice formation unit;

determining a point in time at which ice is to be released during an ice release time determining operation, wherein the point in time at which ice is to be released is based in consideration of a signal from a detection unit for detecting whether the formation of ice has reached an intended level and an ice making lapse time which has lapsed after the formation of ice was initiated by the ice formation unit;

an ice releasing operation of releasing the formed ice when the point in time at which ice is to be released is determined in the ice releasing time determining operation, wherein, in the ice release time determining operation, when the ice making lapse time is equal to a pre-set maximum ice making time, it is determined as an ice releasing time although it is not determined that the formation of ice has reached the intended level by the detection unit, and in the ice release time determining operation, although the ice making lapse time is less than a pre-set minimum ice making time, when it is determined that the formation of ice has reached the intended level by the detection unit, it is determined that it is time to release ice when the minimum ice making time has expired, and wherein the ice formation unit forms ice in a tray member with water therein after water is supplied to the tray member, and the detection unit detects whether or not the formation of ice in the tray member has reached an intended level.

2. The method of claim 1, wherein the minimum ice making time is 80% to 90% of the pre-set maximum ice making time.

3. The method of claim 2, wherein the maximum ice making time or the minimum ice making time is changed according to an outdoor temperature.

4. The method of claim 1, wherein the detection unit comprises a gyration member provided to gyrate in the tray member and a sensor in association with the gyration member, and detects whether or not the formation of ice on dipping members has reached the intended level.

5. The method of claim 1, wherein the ice formation unit comprises one or more dipping members which are immersed in water in the tray member and in which a refrigerant flows.

6. The method of claim 5, wherein, in the ice making operation, water is supplied to the tray member such that the one or more dipping members are immersed in the dipping member, and a cold refrigerant is supplied to the one or more dipping members to form ice on the dipping members, in the ice release time determining operation, a point in time at which the cold refrigerant is supplied to the dipping members is a point in time at which ice starts to be formed, and in the ice releasing operation, ice formed on the one or more dipping members is released.

7. The method of claim 5, wherein, in the ice releasing operation, a hot refrigerant is supplied to the one or more dipping members to release ice formed on the one or more dipping members.

8. The method of claim 1, wherein the ice formation unit comprises:

one or more dipping members immersed in water in the tray member; and a thermoelectric module connected to the one or more dipping members.

9. The method of claim 8, wherein, in the ice making operation, water is supplied to allow the one or more dipping members to be immersed in the tray member and the thermoelectric module is driven to form ice on the dipping members, in the ice release time determining operation, a point in time at which the thermoelectric module is driven is determined as a point in time at which ice starts to be formed, and in the ice releasing operation, ice formed on the one or more dipping members is released.

10. The method of claim 8, wherein, in the ice releasing operation, the thermoelectric module is driven in reverse to release ice formed on the one or more dipping members.

* * * * *